United States Patent [19]

Reber

[11] Patent Number: 5,073,479

[45] Date of Patent: Dec. 17, 1991

[54] CHEMICAL SENSITIZATION OF PHOTOGRAPHIC SILVER HALIDE EMULSIONS

[75] Inventor: Jean F. Reber, Marly, Switzerland

[73] Assignee: Ilford AG, Fribourg, Switzerland

[21] Appl. No.: 597,851

[22] Filed: Oct. 15, 1990

[30] Foreign Application Priority Data

Oct. 14, 1989 [GB] United Kingdom ..... 8923220

[51] Int. Cl.[5] ..... G03C 1/005

[52] U.S. Cl. ..... 430/569; 430/599; 430/607

[58] Field of Search ..... 430/569, 599, 607

[56] References Cited

U.S. PATENT DOCUMENTS

| | | | |
|---|---|---|---|
| 4,040,825 | 8/1977 | Steiger et al. | 430/591 |
| 4,254,217 | 3/1981 | Ohashi et al. | 430/623 |
| 4,879,208 | 11/1989 | Urabe | 430/569 |

FOREIGN PATENT DOCUMENTS 55696 7/1982 European Pat. Off. .

*Primary Examiner*—Charles L. Bowers, Jr.
*Assistant Examiner*—Janet C. Baxter
*Attorney, Agent, or Firm*—Darby & Darby

[57] ABSTRACT

There is described a process for the production of a silver halide emulsion wherein the chemical sensitization is carried out in the presence of N-methyl formamide.

11 Claims, No Drawings

CHEMICAL SENSITIZATION OF PHOTOGRAPHIC SILVER HALIDE EMULSIONS

The present invention relates to chemically sensitized photographic silver halide emulsions. Photographic silver halide emulsions are usually prepared by mixing a soluble silver salt with a soluble alkali metal halide salt in the presence of a colloid, particularly gelatin. Then causing the silver halide crystals to increase in size by the addition of more halide and alkali metal until they have reached the requisite size and are of the requisite habit. However if such silver halide emulsions are to be of camera speed it is required that they be chemically sensitized to increase their speed and contrast.

Conventional methods of chemical sensitization include sulfur sensitization, noble metal sensitization and reduction sensitization, all of which can be used either alone or in combination. However, during chemical sensitization usually the fog increases, very often before the maximum increase in speed is reached. Moreover low intensity reciprocity failure (LIRF) can increase.

It is therefore the object of the present invention to provide silver halide emulsions with high speed, low fog and low LIRF.

According to the present invention the conventional step of chemically sensitizing a silver halide emulsion during production of the emulsion is modified by carrying out the sensitization step in the presence of N-methyl formamide.

N-methyl formamide is hereinafter referred to as NMF. It is to be understood that the NMF may be added to the emulsion before the commencement of chemical sensitization or it may be added to the emulsion with the chemical sensitizers. In the process of the present invention sulfur sensitizers that can be used include thiosulfates, thioureas, thiazoles, rhodanines, and other various compounds. Examples of such sensitizers are described in U.S. Pat. Nos. 1,574,944, 2,410,689, 2,278,947, 2,728,668, 3,656,955, 4,030,928, and 4,067,740.

As reduction sensitizers, stannous salts, amines, hydrazine derivatives, formamidinesulfinic acids and silane compounds can be used, and examples thereof are described in U.S. Pat. Nos. 2,487,850, 2,419,974, 2,518,698, 2,983,610, 2,694,637, 3,930,867, and, 4,054,458.

For noble metal sensitization, gold complex salts, as well as other complex salts of metals belonging to group VIII of the Periodic Table, such as platinum, iridium, and palladium, can be used, and examples thereof are described in U.S. Pat. Nos. 2,399,083 and 2,448,060, and British Pat No. 618,061.

In the process of the present invention it is preferred that the chemical sensitization comprises both sulfur sensitization and noble metal sensitization.

Most preferably the noble metal used is gold. A particularly useful sulphur sensitizer is the long used alkali metal thiosulfate and in particular ammonium thiosulfate. A secondary sulfur sensitizer such as ammonium thiocyanate can be used together with the thiosulfate.

Usually all the chemical sensitizers are added together as an aqueous solution to the silver halide emulsion on completion of crystal growth. Conveniently the NMF can be added at the same time.

Most commonly an antifoggant is added together with the chemical sensitizers. Examples of antifoggants include azoles, such as benzothiazolium salts, nitroindazoles, nitrobenzimidazoles, chlorobenzimidazoles, bromobenzimidazoles, mercaptothiazoles, mercaptobenzaminotriazoles, benztriazoles, nitrobenztriazoles, mercaptotetrazoles (in particular, 1-phenyl-5-mercaptotetrazole), mercaptopyrimidines; mercaptotriazines; thioketo compounds such as oxazolinethion; azaindenes, such as triazaindenes, tetraazaindenes (in particular, 4-hydroxy-substituted (1,3,3a,7)tetraazaindenes), and pentaazaindenes; and benzenesulfonic acid. For example, those described in U.S. Pat. Nos. 3,954,474 and 3,982,947 and Japanese Patent Publication No. 28660/77 can be used.

In the process of the present invention the chemical sensitization step is preferably carried out at a substantially neutral pH in the range pH 6.0 -8.0, preferably pH 7.0, and at a pAg between 5 and 9.

Preferably the chemical sensitization step is carried out at an elevated temperature between 35° and 70° C. and most preferably between 50 ° and 55° C.

Preferably the emulsion is maintained at an elevated temperature for between 10 and 120 minutes during chemical sensitization. A convenient time is forty minutes.

However any of the known procedures for the chemical sensitization of silver halide emulsions can be used in the process of the present invention. Such procedures are described for example, in Research Disclosure No. 17643 of December 1978 and in RD 22534 of January 1983.

The amount of N-Methyl formamide which is necessary to achieve optimum results depends on type and grain size of the emulsion. Generally the NMF is used in an amount ranging from 5 to 500 ml per mole of silver halide. Preferably it is used in an amount of 10 to 200 ml per mole of silver halide.

The silver halide emulsions used in the present invention can be comprised of silver bromide, silver chloride, silver chlorobromide, silver chloroiodide, silver bromoiodide, silver chlorobromoiodide, or mixtures thereof. The emulsions can include coarse, medium or fine silver halide grains and they may have regularly shaped, say, cubic or octahedral, crystals, or they may have irregularly shaped, say, spherical or tabular, crystals. Alternatively, the crystals may be combinations of different phases between the interior and the surface, or they may possess a uniform phase.

The photographic emulsion of the present invention can be prepared by any of the methods described in P. Glafkides, "Chimie et Physique Photographique", Paul Montel, 1967, G.F. Duffin, "Photographic Emulsion Chemistry", The Focal Press, 1966 and V.L. Zelikman et al., "Making and Coating Photographic Emulsion", The Focal Press, 1964. That is, the emulsion may be prepared by an acid process, neutral process or ammonia process. Soluble silver salts may be reacted with soluble halide salts by the single-jet method, double-jet method or a combination thereof. The "reverse mixing method" wherein silver halide grains are formed in the presence of excess silver ions may also be used. The "controlled double-jet method" wherein the medium for forming silver halide grains is kept at a constant level of pAg may be used, and this method is effective for producing a silver halide emulsion comprising grains of a substantially uniform size with regular crystal shapes.

Other methods for the preparation of silver halide emulsions which can be used for the present invention are described, for example, in Research Disclosure No 17643, December 1978, RD No. 22534, January 1983 and RD No. 23212, August 1983.

The emulsions of the present invention may be spectrally sensitized, for example in accordance with Research Disclosure No. 17,643, Sections IIIA and IV, or in accordance with Research Disclosure No. 22,534, pages 24 to 28.

The binders or dispersants for the silver halides and image dyes, if present, to be used are the conventional colloids, for example gelatin or gelatin derivatives, if appropriate in combination with other colloids. Suitable binders or dispersants are described for example in Research Disclosure No. 17,643, Section IX.

Section X of this literature reference has also disclosed compounds which can be used as hardeners for the silver halide emulsions.

A large number of further additives can be added to the silver halide emulsions, for example anti-fogging agents, stabilizers and agents for reducing the pressure sensitivity. These and further additives are known and have been described, for example, in C.E.K. Mees. The Theory of the Photographic Process, 2nd edition, Macmillan 1985, page 677 to 680, and in Research Disclosure No. 17,643, Sections V-VIII, XI-XIV, XVI, XX and XXI.

For processing exposed photographic materials of the present invention the usual well-known developing, fixing and washing procedures may be employed.

The present invention includes photographic silver halide emulsions which have been prepared by the processes of the invention as hereinbefore set forth and also silver halide photographic material which comprises at least one such emulsion layer coated on a photographic film base.

The photographic base may be any of the bases used for photographic film materials for example transparent bases such as cellulose triazcetate, cellulose acetate-butyrate or biaxially orientated polyethylene terephthalate or opaque bases such as baryta coated paper base or polyethylene coated paper base as well as metal foils, glass plates and ceramic plates.

The photographic material of the present invention may be black and white photographic material, colour photographic material, X-ray photographic material or graphic arts photographic material.

The accompanying examples will serve to illustrate the invention.

EXAMPLE 1

A pure silver bromide tabular emulsion with a mean grain volume of 0.55 $\mu m^3$ and an aspect ratio of 6:1 is prepared and desalted in the usual manner. The emulsion was prepared by a slow single jetting process with an initial bromide excess of 0.5 molar and at an elevated temperature of 80° C.; these conditions being chosen to favor the tabular crystal habit. For chemical sensitization per mole of silver halide are added: 13.9$\mu$ moles of $(NH_4)_2S_2O_3$, 7$\mu$ moles of H Au $Cl_4$, 41 m moles of $NH_4$ SCN, 0.82 mg of the potassium salt of p-toluenethiosulfonate and 64 ml of N-methyl formamide.

The emulsion is then adjusted to pH 7.0 and pAg 8.4, heated to 55° C. and kept at this temperature for 40 minutes.

A second emulsion is made in the same manner but without addition of N-methyl formamide for comparison.

Both emulsions are coated on a transparent polyester film with a coating weight of 2.65 g silver per $m^2$, exposed behind a step-wedge and then processed as follows:

| | |
|---|---|
| Development | 3.0 minutes |
| Washing | 0.5 minutes |
| Fixing | 1.5 minutes |
| Washing | 3.0 minutes |
| Drying | |

The temperature of each of the baths used is 30° C. The developing bath contains the following components per liter of solution:

| | |
|---|---|
| Sodium sulfite | 38.0 g |
| Potassium sulfite | 19.9 g |
| Lithium sulfite | 0.6 g |
| 1-phenyl-3-pyrazolidinone | 0.5 g |
| Hydroquinone | 8.0 g |
| Potassium carbonate | 19.5 g |
| Potassium bicarbonate | 13.3 g |
| Potassium bromide | 3.5 g |
| Benzotriazole | 1.0 g |
| Sodium thiosulfate | 0.9 g |
| Sodium ethylenediamine tetraacetate | 4.0 g |

The fixing bath contains, per liter of solution:

| | |
|---|---|
| Ammonium thiosulfate | 200 g |
| Ammonium bisulfite | 12 g |
| Ammonium sulfite | 39 g |

The evaluation of the both materials gives the following sensitometric values:

| | D-Min | Log S[x] | LIRF[xx] |
|---|---|---|---|
| Emulsion 1 | 0.036 | −0.61 | −0.19 |
| Emulsion 2 (comparison) | 0.072 | −0.57 | −0.43 |

[x]log S = log sensitivity at 0.5 maximum density for 1 sec exposure time
[xx]LIRF = log S (1 sec exposure)-log S (512 sec exposure)

This shows that for the emulsion of the present invention the fog (D-Min) is less than the comparison, the speed (log S) is higher whilst the reciprocity failure LIRF is less than the comparison.

EXAMPLE 2

A silver bromide tubular grain emulsion with a shell of pure silver chloride (5.2 mol - % of the total amount of silver) and a mean grain volume of 0.46 $\mu$m3 and an aspect ratio of 6:1 is prepared and desalted in the usual manner. The emulsion was prepared by a slow single jetting process with an initial chloride excess of 0.5 molar and at an elevated temperature of 80° C.; these conditions being chosen to favor the tabular crystal habit.

For chemical sensitization per mole of silver halide are added: 51.0 ml N-methylformamide, 13$\mu$ moles of $(NH_4)_2S_2O_3$, 3,6$\mu$ moles H Au $Cl_4$, 21.2 m moles $NH_4SCN$ and 2.2 mg of the potassium salt of p-toluenethiosulfonate.

The emulsion is adjusted to pH 6.7 and pAg 7.8, heated to 55° C. and kept at this temperature for 60 minutes.

For comparison a second emulsion is prepared in the same manner but without addition of N-methyl formamide.

The emulsions are coated on a transparent polyester film with a coating weight of 2.65 g silver per $m^2$ and exposed and processed as described in example 1.

The following sensitometric results are obtained.

| | D-Min | Log S | LIRF |
|---|---|---|---|
| Emulsion 3 | 0.025 | −0.60 | −0.23 |
| Emulsion 4 (comparison) | 0.023 | −0.38 | −0.36 |

This shows that the fog for the emulsion of the invention is virtually the same as the comparison but the speed is greatly increased. The LIRF is also lower than the comparison.

EXAMPLE 3

A silver iodobromide emulsion with an iodide content of 3.8 mol - %, consisting of tabular grains with a mean volume of 0.36 $\mu m^3$ and an aspect ratio of 6:1 is prepared in the usual manner. The emulsion was prepared by a slow single jetting process with an initial bromide excess of 0.5 molar and at an elevated temperature of 80° C.; these conditions being chosen to favor the tabular crystal habit. Per mole of silver halide are then added: 60 ml N-methylformamide, 14.2$\mu$ moles $(NH_4)_2S_2O_3$, 7$\mu$ moles H Au $Cl_4$, 41.1 m moles $HN_4SCN$ and 0.82 mg of the potassium salt of p-toluene thiosulfonate. The pH is adjusted to 7.1 and the pAg to 8.3. The mixture is heated to 55° C. and kept at this temperature for 40 minutes.

For comparison a second emulsion is prepared in the same manner but without addition of N-methylformamide.

The emulsions are coated on a transparent polyester film with a coating weight of 2.60 g silver per $m^2$ and, after exposure, processed as follows :

| | |
|---|---|
| Development | 60 seconds |
| Washing | 20 seconds |
| Fixing | 60 seconds |
| Washing | 60 seconds |
| Drying | |

The temperature of each of the baths used is 39° C. The developing bath contains the following components per liter of solution:

| | |
|---|---|
| Sodium sulfite | 15 g |
| Potassium sulfite | 37 g |
| 1-Phenyl-3-pyrazolidinone | 0.5 g |

-continued

| | |
|---|---|
| Hydroquinone | 15 g |
| Potassium metaborate | 11 g |
| Boric acid | 7.7 g |
| Potassium ascorbate | 12.3 g |
| Potassium bromide | 2.0 g |
| Benzotriazole | 0.9 g |
| Sodium ethylenediaminetetraacetate | 2.0 |

The fixing bath is the same as in Example 1. The following sensitometric results are obtained:

| | D-Min | Log 5 | LIRF |
|---|---|---|---|
| Emulsion 5 | 0.05 | −1.24 | −0.44 |
| Emulsion 6 (comparison) | 0.05 | −0.98 | −0.63 |

This shows that the fog is the same as the comparison for the emulsion of the present invention but the speed is much greater. LIRF is also reduced compared with the comparison.

I claim as my invention:

1. A process for the production of a silver halide emulsion wherein the chemical sensitization step is carried out in the presence of N-methyl formamide.

2. A process according to claim 1 wherein the N-methyl formamide is present during the chemical sensitization in an amount within the range from about 5 to about 500 ml per mole of silver halide in the emulsion.

3. A process according to claim 2 wherein the amount of N-methyl formamide is within the range from 10 to 200 ml per mole of silver halide in the emulsion.

4. A process according to claim 1 wherein the chemical sensitization is carried out using ammonium thiosulfate and a gold complex salt.

5. A process according to claim 2 wherein the chemical sensitization is carried out using ammonium thiosulfate and a gold complex salt.

6. A process according to claim 3 wherein the chemical sensitization is carried out using ammonium thiosulfate and a gold complex salt.

7. A silver halide emulsion which has been prepared by the process of claim 1.

8. A silver halide emulsion which has been prepared by the process of claim 2.

9. A silver halide emulsion which has been prepared by the process of claim 3.

10. A silver halide emulsion which has been prepared by the process of claim 4.

11. Photographic silver halide material which comprises at least one layer comprising the silver halide emulsion according to claim 7.

* * * * *